US011828045B2

(12) United States Patent
Misaki

(10) Patent No.: US 11,828,045 B2
(45) Date of Patent: Nov. 28, 2023

(54) EXCAVATOR

(71) Applicant: SUMITOMO CONSTRUCTION MACHINERY CO., LTD., Tokyo (JP)

(72) Inventor: Youji Misaki, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 17/649,948

(22) Filed: Feb. 4, 2022

(65) Prior Publication Data

US 2022/0154427 A1 May 19, 2022

Related U.S. Application Data

(63) Continuation of application No. PCT/JP2020/030525, filed on Aug. 7, 2020.

(30) Foreign Application Priority Data

Aug. 8, 2019 (JP) ..... 2019-146179

(51) Int. Cl.
*E02F 9/22* (2006.01)
*E02F 3/32* (2006.01)
(Continued)

(52) U.S. Cl.
CPC ..... *E02F 9/2235* (2013.01); *E02F 3/32* (2013.01); *E02F 3/435* (2013.01); *E02F 9/2037* (2013.01);
(Continued)

(58) Field of Classification Search
CPC ..... E02F 9/2228; E02F 9/226; E02F 9/2282; E02F 9/2285
See application file for complete search history.

(56) References Cited

U.S. PATENT DOCUMENTS 10,590,628 B2 * 3/2020 Ariga ..... E02F 9/24
11,041,290 B2 * 6/2021 Kodaka ..... E02F 9/2228
(Continued)

FOREIGN PATENT DOCUMENTS

JP 2004-124544 4/2004
JP 2010-286116 12/2010
(Continued)

OTHER PUBLICATIONS

International Search Report for PCT/JP2020/030525 dated Oct. 27, 2020.

*Primary Examiner* — Michael Leslie
(74) *Attorney, Agent, or Firm* — IPUSA, PLLC

(57) ABSTRACT

An excavator includes a control valve configured to control hydraulic oil to be supplied to an actuator, based on pilot pressure; an electric operation device configured to output an operation signal; a gate lock device; a gate lock valve provided on a pilot line supplying the pilot pressure to the control valve, and configured to open or close according to a state of the gate lock device, so as to switch between a locked state and a released state; a proportional valve provided on the pilot line; and a control part configured to receive as input the operation signal, to control the proportional valve, wherein the control part determines, in a case where the gate lock valve is in the locked state by the gate lock device and an operation is performed on the electric operation device, the operation as an operational error.

5 Claims, 7 Drawing Sheets

(51) Int. Cl.
*E02F 3/43* (2006.01)
*E02F 9/20* (2006.01)

(52) U.S. Cl.
CPC ..... *E02F 9/226* (2013.01); *E02F 9/2228* (2013.01); *E02F 9/2267* (2013.01); *E02F 9/2285* (2013.01); *E02F 9/2296* (2013.01); *E02F 9/2282* (2013.01)

(56) References Cited

U.S. PATENT DOCUMENTS

| | | | | |
|---|---|---|---|---|
| 11,299,867 | B2 * | 4/2022 | Kurokawa | E02F 9/2285 |
| 11,371,212 | B2 * | 6/2022 | Tsuchie | E02F 9/226 |
| 11,453,995 | B2 * | 9/2022 | Ito | E02F 3/437 |
| 11,479,945 | B2 * | 10/2022 | Yamamoto | E02F 9/262 |
| 2010/0313556 | A1 | 12/2010 | Kim | |
| 2014/0060026 | A1 | 3/2014 | Himoto et al. | |
| 2018/0245313 | A1 | 8/2018 | Shibamori et al. | |
| 2019/0226180 | A1 | 7/2019 | Kim | |
| 2020/0032482 | A1 * | 1/2020 | Meguriya | E02F 9/2285 |
| 2020/0048867 | A1 | 2/2020 | Kimura et al. | |
| 2022/0267998 | A1 * | 8/2022 | Nishikawa | E02F 9/24 |
| 2022/0307228 | A1 * | 9/2022 | Maehara | E02F 9/2228 |

FOREIGN PATENT DOCUMENTS

| | | |
|---|---|---|
| JP | 2011-132795 | 7/2011 |
| JP | 2013-036270 | 2/2013 |
| JP | 5986042 | 9/2016 |
| JP | 2018-204252 | 12/2018 |
| JP | 2019-044333 | 3/2019 |
| WO | 2013/179517 | 12/2013 |
| WO | 2017/141500 | 8/2017 |

* cited by examiner

EXCAVATOR

CROSS-REFERENCE TO RELATED APPLICATION

The present application is a continuation application of International Application No. PCT/JP2020/030525 filed on Aug. 7, 2020, which is based on and claims priority to Japanese Patent Application No. 2019-146179, filed on Aug. 8, 2019. The contents of these applications are incorporated herein by reference in their entirety.

TECHNICAL FIELD

The present disclosure relates to an excavator.

BACKGROUND

For example, a working vehicle is disclosed that includes a pilot valve that outputs pilot pressure in response to an operation on an operation member; an actuator control valve that controls a hydraulic actuator in response to the pilot pressure; a lock valve that cuts off supply of the pilot pressure to the actuator control valve, wherein once the pilot pressure becomes greater than or equal to a predetermined pressure within a predetermined period of time after releasing the lock valve, the lock valve is switched to a locked state.

However, the disclosed method detects the pilot pressure, and then, detects an operation or an operational error on the operation member. Therefore, there has been a problem that the actuator may move somewhat until the pilot pressure rises to be greater than or equal to a predetermined pressure.

SUMMARY

According to one embodiment in the present disclosure, an excavator is provided that includes a control valve configured to control hydraulic oil to be supplied to an actuator, based on pilot pressure; an electric operation device configured to output an operation signal; a gate lock device; a gate lock valve provided on a pilot line supplying the pilot pressure to the control valve, and configured to open or close according to a state of the gate lock device, so as to switch between a locked state and a released state; a proportional valve provided on the pilot line; and a control part configured to receive as input the operation signal, to control the proportional valve, wherein the control part determines, in a case where the gate lock valve is in the locked state by the gate lock device and an operation is performed on the electric operation device, the operation as an operational error.

EMBODIMENTS FOR CARRYING OUT THE INVENTION

In the following, embodiments for implementing the present inventive concept will be described with reference to the drawings.

According to an embodiment in the present disclosure, an excavator that prevents an operation of an actuator not intended by the operator can be provided.

Figure 1:
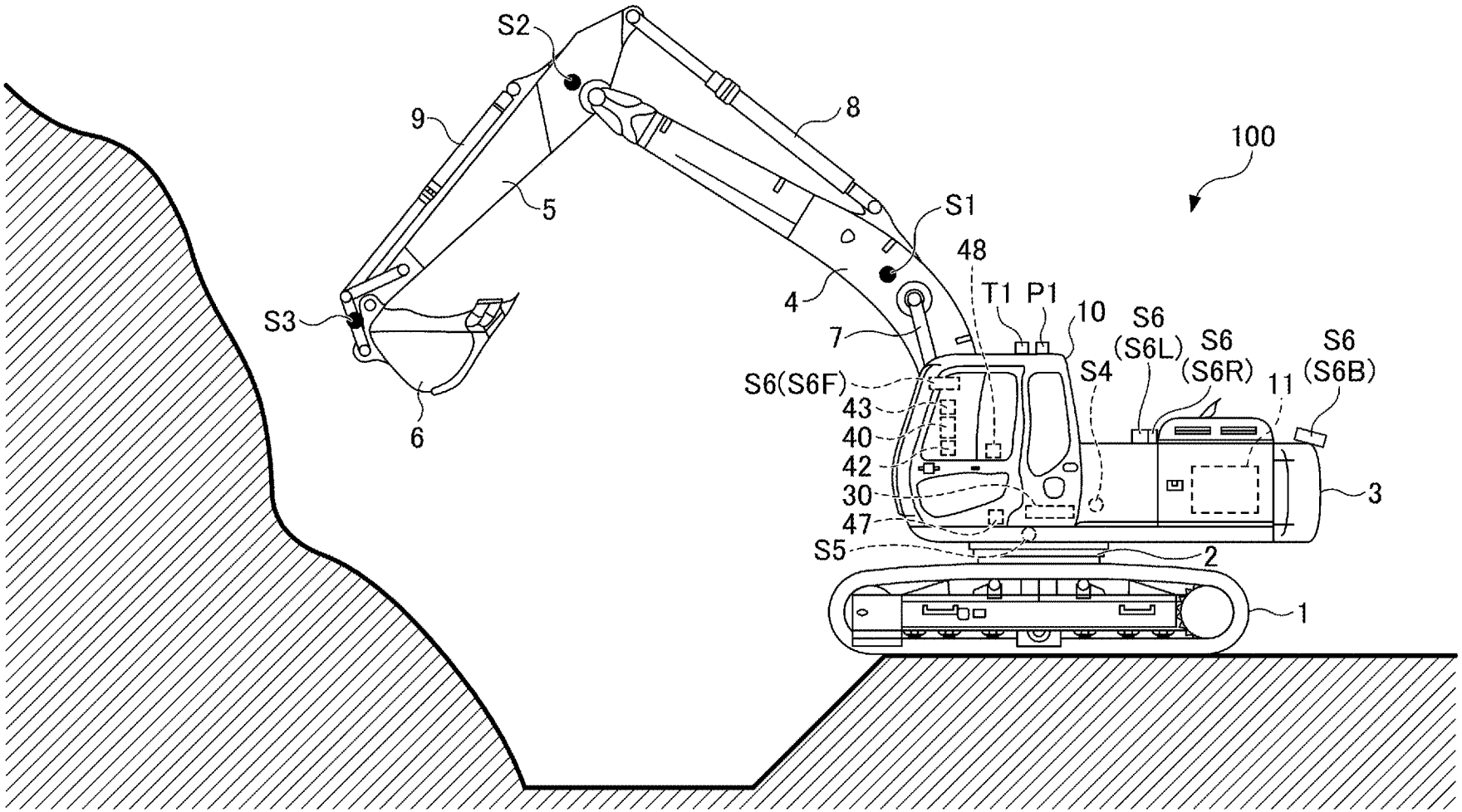
FIG. 1 is a side view of an excavator according to an embodiment in the present disclosure.

FIG. 1 is a side view of an excavator 100 as an excavation machine according to the present embodiment. On a traveling lower body 1 of the excavator 100, a revolving upper body 3 is rotatably installed via a revolution mechanism 2. A boom 4 is attached to the revolving upper body 3. An arm 5 is attached to the tip of the boom 4; and a bucket 6 as an end attachment is attached to the tip of the arm 5.

The boom 4, the arm 5, and the bucket 6 constitute an excavation attachment as an example of an attachment. Further, the boom 4 is driven by a boom cylinder 7, the arm 5 is driven by an arm cylinder 8, and the bucket 6 is driven by a bucket cylinder 9.

Specifically, the boom cylinder 7 is driven according to the tilt of a boom control lever; the arm cylinder 8 is driven according to the tilt of an arm control lever; and the bucket cylinder 9 is driven according to the tilt of a bucket control lever. Similarly, the right hydraulic motor for traveling 1R (see FIG. 2) is driven according to the tilt of a right traveling lever; the left hydraulic motor for traveling 1L (see FIG. 2) is driven according to the tilt of a left traveling lever; and the hydraulic motor for revolution 2A (see FIG. 2) is driven according to the tilt of a revolution control lever. In this way, the actuators are driven according to operations on the respective levers, and control of the excavator 100 is executed by manual operations performed by the operator (hereafter, referred to as the "manual control").

Also, a boom angle sensor S1 is attached to the boom 4, an arm angle sensor S2 is attached to the arm 5, and a bucket angle sensor S3 is attached to the bucket 6.

The boom angle sensor S1 is configured to detect the angle of rotation of the boom 4. In the present embodiment, the boom angle sensor S1 is an acceleration sensor and can detect the angle of rotation of the boom 4 with respect to the revolving upper body 3 (hereafter, referred to as the boom angle). The boom angle becomes the minimum angle, for example, when the boom 4 comes to the lowest position, and becomes greater while the boom 4 is raised to a higher position.

The arm angle sensor S2 is configured to detect the angle of rotation of the arm 5. In the present embodiment, the arm angle sensor S2 is an acceleration sensor and can detect the angle of rotation of the arm 5 with respect to the boom 4 (hereafter, referred to as the arm angle). The arm angle becomes the minimum angle, for example, when the arm 5 is closed most, and becomes greater while the arm 5 is opened wider.

The bucket angle sensor S3 is configured to detect the angle of rotation of the bucket 6. In the present embodiment, the bucket angle sensor S3 is an acceleration sensor and can detect the angle of rotation of the bucket 6 with respect to the arm (hereafter, referred to as the bucket angle). The bucket angle becomes the minimum angle, for example, when the bucket 6 is closed most, and becomes greater while the bucket 6 is opened wider.

Each of the boom angle sensor S1, the arm angle sensor S2, and the bucket angle sensor S3 may be a potentiometer using a variable resistor; a stroke sensor for detecting a stroke amount of a corresponding hydraulic cylinder; a rotary encoder for detecting an angle of rotation around a coupling pin; an inertia measurement unit; a gyro sensor; a combination of an acceleration sensor and a gyro sensor; or the like.

The revolving upper body 3 is provided with a cabin 10 as the driver's cab, and has a power source such as an engine 11 installed. A controller 30, a display device 40, an input device 42, a sound output device 43, a storage device 47, an emergency stop switch 48, a machine tilt sensor S4, a rotational angular velocity sensor S5, an imaging device S6, a communication device T1, and a positioning device P1 are attached to the revolving upper body 3.

The controller 30 is configured to function as a control unit to control driving the excavator 100. In the present embodiment, the controller 30 is constituted with a computer that includes a CPU, a RAM, a ROM, and the like. Various functions provided by the controller 30 are implemented by, for example, the CPU executing a program stored in the ROM. The various functions includes, for example, a machine guidance function of guiding a manual operation of the excavator 100 performed by an operator, and a machine control function of automatically supporting a manual operation of the excavator 100 performed by the operator. The machine guidance device 50 included in the controller 30 (see FIG. 2) is configured to be capable of executing the machine guidance function and the machine control function.

The display device 40 is configured to display various items of information. The display device 40 may be connected to the controller 30 via a communication network such as a CAN, or may be connected to the controller 30 via dedicated lines.

The input device 42 is configured to allow an operator to input various items of information into the controller 30. The input device 42 may include, for example, at least one of a touch panel, a knob switch, and a membrane switch installed in the cabin 10.

The sound output device 43 is configured to output sound information. The sound output device 43 may be, for example, an in-vehicle speaker connected to the controller 30, or may be an alarm such as a buzzer. In the present embodiment, the sound output device 43 outputs a various items of sound information in response to commands from the controller 30.

The storage device 47 is configured to store various items of information. The storage device 47 is, for example, a non-volatile storage medium such as a semiconductor memory. The storage device 47 may store information output by various devices during operations of the excavator 100, and may store information obtained via the various devices before operations of the excavator 100 is started. The storage device 47 may store, for example, data related to a target formation level obtained via the communication device T1 or the like. The target formation level may be set by the operator of the excavator 100, or may be set by a construction manager or the like.

The emergency stop switch 48 is configured to function as a switch to stop movement of the excavator 100. The emergency stop switch 48 is, for example, a switch arranged at a position that can be operated by the operator sitting in the driving seat in the cabin 10. In the present embodiment, the emergency stop switch 48 is a foot-pedal switch arranged at the operator's feet in the cabin 10. When operated by the operator, the emergency stop switch 48 outputs a command to an engine control unit, to stop the engine 11. Note that the emergency stop switch 48 may be a hand-push switch arranged around the driving seat.

The machine tilt sensor S4 is configured to detect the tilt of the revolving upper body 3. In the present embodiment, the machine tilt sensor S4 is an acceleration sensor to detect the tilt angle of the revolving upper body 3 with respect to a virtual horizontal plane. The machine tilt sensor S4 may be a combination of an acceleration sensor and a gyro sensor, or may be an inertia measurement unit or the like. The machine tilt sensor S4 is an acceleration sensor to detect, for example, the tilt angle around the front-and-back axis (roll angle) and the tilt angle around the right-and-left axis (pitch angle) of the revolving upper body 3. The front-and-back axis and the right-and-left axis of the revolving upper body 3 are, for example, orthogonal to each other at the center point of the excavator as a point along the pivot of the excavator 100.

The imaging device S6 is configured to obtain an image in the surroundings of the excavator 100. In the present embodiment, the imaging device S6 includes a forward camera S6F to capture an image of a space in front of the excavator 100; a left camera S6L to capture an image of a space on the left of the excavator 100; a right camera S6R to capture an image of a space on the right of the excavator 100; and a rear camera S6B to capture an image of a space behind the excavator 100.

The imaging device S6 is, for example, a monocular camera having an imaging element such as a CCD or CMOS, and outputs a captured image to the display device 40. The imaging device S6 may be configured to function as a space recognition device S7 (see FIG. 2)

The space recognition device S7 is configured to recognize objects present in a three-dimensional space in the surroundings of the excavator 100. An object is, for example, at least one of a person, an animal, an excavator, a machine, or a building. The space recognition device S7 may be configured to calculate the distance between the space recognition device S7 or the excavator 100 and an object detected by the space recognition device S7. The space recognition device S7 may be an ultrasonic sensor, a millimeter-wave radar, a monocular camera, a stereo camera, a LIDAR device, a distance image sensor, an infrared sensor, or the like.

The forward camera S6F is attached, for example, to the ceiling of the cabin 10, namely, inside of the cabin 10. However, the forward camera S6F may be attached to the roof of the cabin 10, namely, outside of the cabin 10. The left camera S6L is attached to the left end on the upper surface of the revolving upper body 3; the right camera S6R is attached to the right end on the upper surface of the revolving upper body 3; and the rear camera S6B is attached to the rear end on the upper surface of the revolving upper body 3.

The communication device T1 is configured to control communication with an external device external to the excavator 100. In the present embodiment, the communication device T1 controls communication with the external device via at least one of a satellite communication network, a cellular telephone communication network, a short-distance wireless communication network, and the Internet.

The positioning device P1 is configured to measure the position of the revolving upper body 3. The positioning device P1 may be configured to measure the orientation of the revolving upper body 3. The positioning device P1 is, for example, a GNSS compass to detect the position and orientation of the revolving upper body 3, and outputs the detected values to the controller 30. Therefore, the positioning device P1 may also function as an orientation detection device to detect the orientation of the revolving upper body 3. The orientation detection device may be a direction sensor attached to the revolving upper body 3. Also, the position and the orientation of the revolving upper body 3 may be configured to be measured by the rotational angular velocity sensor S5.

The rotational angular velocity sensor S5 is configured to detect the revolutional angular velocity of the revolving upper body 3. The rotational angular velocity sensor S5 may be configured to be capable of detecting or calculating the revolutional angular velocity of the revolving upper body 3. In the present embodiment, the rotational angular velocity sensor S5 is a gyro sensor. The rotational angular velocity sensor S5 may be a resolver, a rotary encoder, an inertia measurement unit, or the like.

Figure 2:
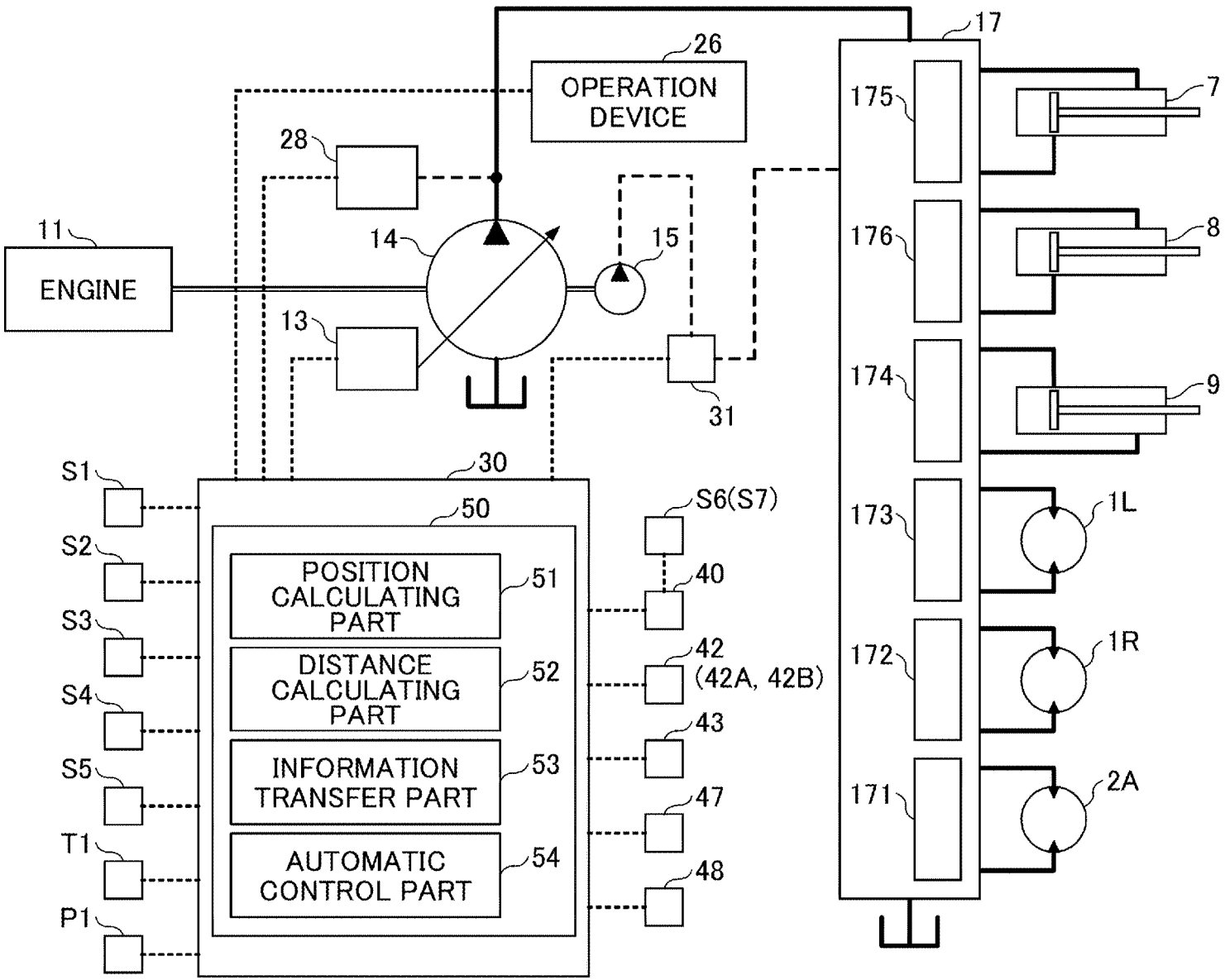
FIG. 2 is a diagram illustrating an example of a configuration of a basic system of the excavator in FIG. 1.

FIG. 2 is a diagram illustrating an example of a configuration of a basic system of the excavator 100, in which mechanical power transmission lines, hydraulic oil lines, pilot lines, and electric control lines are designated with double lines, solid lines, dashed lines, and dotted lines, respectively.

The basic system of the excavator 100 primarily includes the engine 11, regulators 13, main pumps 14, a pilot pump 15, control valves 17, an operation device 26, discharge pressure sensors 28, the controller 30, proportional valves 31, and the like.

The engine 11 is the driving source of the excavator 100. In the present embodiment, the engine 11 is a diesel engine that operates to maintain a predetermined number of revolutions. The output shaft of the engine 11 is coupled with the respective input shafts of the main pumps 14 and the pilot pump 15.

The main pump 14 is configured to supply hydraulic oil to the control valves 17 via hydraulic oil lines. In the present embodiment, the main pump 14 is a swashplate-type, variable-capacity hydraulic pump.

The regulator 13 is configured to control the discharge amount of the main pump 14. In the present embodiment, in response to a control command from the controller 30, the regulator 13 adjusts the tilt angle of the swashplate of the main pump 14, so as to control the discharge amount of the main pump 14. The controller 30 receives outputs from, for example, the operation device 26, the discharge pressure sensors 28, and the like, and when necessary, outputs a control command to the regulator 13 to change the amount of discharge of the main pump 14.

The pilot pump 15 is configured to supply hydraulic oil to hydraulic control devices including the proportional valves 31 via the pilot lines. In the present embodiment, the pilot pump 15 is a fixed-capacity hydraulic pump. However, the pilot pump 15 may be omitted. In this case, the functions implemented by the pilot pump 15 may be implemented by the main pump 14. In other words, in addition to the function of supplying hydraulic oil to the control valves 17, the main pump 14 may include a function of supplying hydraulic oil to the proportional valves 31 and the like after lowering the pressure of the hydraulic oil by a throttle or the like.

The control valves 17 constitute a hydraulic control device that controls the hydraulic system in the excavator 100. In the present embodiment, the control valves 17 include control valves 171 to 176. The control valves 17 can selectively supply hydraulic oil discharged by the main pumps 14 to one or more hydraulic actuators through the control valves 171 to 176. The control valves 171 to 176 control the flow rate of the hydraulic oil flowing from the main pumps 14 to the hydraulic actuators, and the flow rate of the hydraulic oil flowing from the hydraulic actuators to the hydraulic oil tank. The hydraulic actuators include the boom cylinder 7, the arm cylinder 8, the bucket cylinder 9, the left hydraulic motor for traveling 1L, a right hydraulic motor for traveling 1R, and a hydraulic motor for revolution 2A. The hydraulic motor for revolution 2A may be an electric motor generator for revolution as an electric actuator.

The operation device 26 is a device used by the operator for operating the actuators. The actuators include at least one of a hydraulic actuator and an electric actuator. In the present embodiment, the operation device 26 includes levers (the boom control lever, the arm control lever, the bucket control lever, the left traveling lever, the right traveling lever, and the revolution control lever) corresponding to the respective actuators (the boom cylinder 7, the arm cylinder 8, the bucket cylinder 9, the left hydraulic motor for traveling 1L, the right hydraulic motor for traveling 1R, and the hydraulic motor for revolution 2A). The operation device 26 detects the operational direction and the operational amount of each lever, and outputs the detected operational direction and the operational amount to the controller 30 as operational data (an electric signal).

The discharge pressure sensors 28 are configured to detect the discharge pressure of the main pumps 14. In the present embodiment, the discharge pressure sensors 28 output the detected values to the controller 30.

The proportional valve 31 (a solenoid proportional valve) is arranged in a pipeline connecting the pilot pump 15 and a corresponding control valve 17 (the control valve 171 to 176), and is configured to capable of changing the flow area of the pipeline. In the present embodiment, the proportional valve 31 is a solenoid valve that operates in response to a command output by the controller 30. For example, while manual control is performed, the controller 30 controls the opening of the proportional valve 31, in accordance with the operational direction and operational amount of the operation device 26. In this way, in response to an operation on the operation device 26 performed by the operator, the controller 30 can supply hydraulic oil discharged by the pilot pump 15 to the pilot port of a corresponding control valve 17 from among the control valves 171 to 176, via the proportional valves 31. Also, each proportional valve 31 functions as a control valve for machine control. Therefore, regardless of an operation on the operation device 26 performed by the operator, the controller 30 can supply hydraulic oil discharged by the pilot pump 15 to the pilot port of a corresponding control valve 17 from among the control valves 171 to 176, via the proportional valves 31. With this configuration, even in the case where no operation is performed on a particular element of the operation device 26, the controller 30 can cause a hydraulic actuator corresponding to the particular element of the operation device 26 to operate.

Next, the machine guidance device 50 included in the controller 30 will be described. The machine guidance device 50 is configured to execute, for example, a machine guidance function. In the present embodiment, the machine guidance device 50 informs the operator about work information, for example, about the distance between a target formation level and a working member of the attachment. Data related to the target formation level is stored in advance, for example, in the storage device 47. In addition, data related to the target formation level is expressed, for example, in a reference coordinate system. The reference coordinate system is, for example, the World Geodetic System. The operator may define any point of a construction site as a reference point, to set a target formation level by the relative positional relationship between points on the target formation level and the reference point. The working member of the attachment is, for example, the teeth end of the bucket 6 or the back face of the bucket 6. The machine guidance device 50 guides an operation of the excavator 100, by informing the operator of the work information, through at least one of the display 40 and the sound output device 43.

The machine guidance device 50 may execute a machine control function that automatically supports manual operations of the excavator 100 performed by the operator. For example, when the operator manually performs an excavation operation, the machine guidance device 50 may cause at least one of the boom 4, the arm 5, and the bucket 6 to operate automatically, so as to maintain the distance between the target formation level and the teeth end of the bucket 6 to be a predetermined value.

In the present embodiment, although the machine guidance device 50 is built in the controller 30, the machine guidance device 50 may be a control device that is provided separately from the controller 30. In this case, as in the case of the controller 30, the machine guidance device 50 is constituted with, for example, a computer that includes a CPU, a RAM, a ROM, and the like. Also, various functions provided by the machine guidance device 50 are implemented by, for example, the CPU executing a program stored in the ROM. Also, the machine guidance device 50 and the controller 30 are communicably connected to each other through a communication network such as a CAN.

Specifically, the machine guidance device 50 obtains information from at least one of the boom angle sensor S1, the arm angle sensor S2, the bucket angle sensor S3, the machine tilt sensor S4, the rotational angular velocity sensor S5, the imaging device S6, the positioning device P1, the communication device T1, and the input device 42. In addition, the machine guidance device 50 calculates the distance between the bucket 6 and the target formation level, for example, based on the obtained information, and by at least one of sound and light (image display), informs the operator of the excavator 100, about the magnitude of the distance between the bucket 6 and the target formation level.

Also, in order to be capable of executing the machine control function that automatically supports manual operations, the machine guidance device 50 includes a position calculating part 51, a distance calculating part 52, an information transfer part 53, and an automatic control part 54.

The position calculating part 51 is configured to calculate the position of an object. In the present embodiment, the position calculating part 51 calculates the coordinate point of an operating part of the attachment in the reference coordinate system. Specifically, The position calculating part 51 calculates the coordinate point of the teeth end of the bucket 6 from the respective angles of rotation of the boom 4, the arm 5, and the bucket 6. The position calculating part 51 may calculate not only the coordinate point of the center on the teeth end of the bucket 6, but also the coordinate point of the left end on the teeth end of the bucket 6, and the coordinate point of the right end on the teeth end of the bucket 6. In this case, the output of the machine tilt sensor S4 may be used.

The distance calculating part 52 is configured to calculate the distance between two objects. In the present embodiment, the distance calculating part 52 calculates the vertical distance between the teeth end of the bucket 6 and the target formation level. The distance calculating part 52 may calculate the distances (e.g., the vertical distances) between the target formation level and the respective coordinate points at the left and right ends of the teeth end of the bucket 6, so that the machine guidance device 50 can determine whether or not the excavator 100 faces the target formation level.

The information transfer part 53 is configured to inform the operator of the excavator 100, about various items of information. In the present embodiment, the information transfer part 53 informs the operator of the excavator 100, about the magnitude of the distance calculated by the distance calculating part 52. Specifically, the information transfer part 53 informs the operator of the excavator 100, about the vertical distance between the teeth end of the bucket 6 and the target formation level, by using visual information and auditory information.

For example, the information transfer part 53 may inform the operator about the vertical distance between the teeth end of the bucket 6 and the target formation level, by using intermittent sounds generated by the sound output device 43. In this case, for a smaller vertical distance, the information transfer part 53 may make the interval of the intermittent sounds shorter. The information transfer part 53 may use a continuous sound, or may change the sound in pitch, in volume, or the like to express differences in the magnitude of the vertical distance. Also, the information transfer part 53 may raise an alarm if the teeth end of the bucket 6 comes lower than the target formation level. The alarm is, for example, a continuous sound that is noticeably louder than the intermittent sound.

The information transfer part 53 may display the magnitude of the vertical distance between the teeth end of the bucket 6 and the target formation level, as work information on the display device 40. The display 40 displays the work information received from the information transfer part 53 on the screen, for example, together with image data received from the imaging device S6. The information transfer part 53 may inform the operator about the magnitude of the vertical distance, by using, for example, an image of an analog meter, an image of a bar graph indicator, or the like.

The automatic control part 54 is configured to automatically support a manual operation of the excavator 100 performed by the operator, by causing the actuators to operate automatically. For example, in the case where the operator is manually performing an arm-closing operation, the automatic control part 54 may cause at least one of the boom cylinder 7, the arm cylinder 8, and the bucket cylinder 9 to expand or contract automatically, so as to maintain the distance between the target formation level and the teeth end of the bucket 6 to be a predetermined value. In this case, for example, by simply operating the arm operation lever in the closing direction, the operator can close the arm 5 while maintaining the distance between the target formation level and the teeth end of the bucket 6. Such automatic control may be configured to be executed when a predetermined switch as one element of the input device 42 is pressed down. In other words, when a predetermined switch is pressed, the automatic control part 54 may switch the operation mode of the excavator 100 from the manual control mode to the automatic control mode. The manual control mode means an operation mode in which the manual control is executed, and the automatic control mode means an operation mode in which the automatic control is executed. The predetermined switch is, for example, a machine control switch (hereafter, referred to as the "MC switch 42A"), and may be arranged at the holder part of an operation lever as a knob switch. In this case, by pressing the MC switch 42A once again, the operator may switch the operation mode of the excavator 100 from the automatic control mode to the manual control mode, or by pressing another machine control stop switch (hereafter, referred to as the "MC switch 42B") as a switch different from the MC switch 42A, may switch the operation mode of the excavator 100 from the automatic control mode to the manual control mode. The MC stop switch 42B may be arranged adjacent to the MC switch 42A, or may be arranged in the holder part of the operation lever. Alternatively, the MC stop switch 42B may be omitted.

Alternatively, such automatic control may be configured to be executed while the MC switch 42A is pressed down. In this case, for example, by simply operating the arm operation lever in the closing direction while pressing the MC switch 42A located at the holder part of the arm operation lever, the operator can close the arm 5 while maintaining the distance between the target formation level and the teeth end of the bucket 6. This is because the boom cylinder 7 and the bucket cylinder 9 automatically moves following the arm-closing operation by the arm cylinder 8. Also, the operator can stop the automatic control simply by releasing the finger from the MC switch 42A. In the following, control that automatically operates an excavation attachment while maintaining the distance between the target formation level and the teeth end of the bucket 6, will be referred to as the "automatic excavation control" as one type of automatic control (machine control function).

The automatic control part 54 may automatically rotate the hydraulic motor for revolution 2A to cause the revolving upper body 3 to face the target formation level, when a predetermined switch such as the MC switch 42A is pressed. In this case, by simply pressing a predetermined switch, or by simply operating the revolution control lever in a state of the predetermined switch being pressed, the operator can cause the revolving upper body 3 to face the target formation level. Alternatively, by simply pressing a predetermined switch, the operator can cause the revolving upper body 3 to face the target formation level, and to start the machine control function, in other words, can cause the state of the excavator 100 to transition to a state in which the automatic control can be executed. In the following, control of causing the revolving upper body 3 to face the target formation level will be referred to as the "automatic facing control" as one type of automatic control (machine control function).

The automatic control part 54 may be configured to execute a boom-up revolution or a boom-down revolution automatically, when a predetermined switch such as the MC switch 42A is pressed. In this case, by simply pressing a predetermined switch, or by simply operating the revolution control lever in a state of the predetermined switch being pressed, the operator can start a boom-up revolution or a boom-down revolution. In the following, control of automatically starting a boom-up revolution or a boom-down revolution, will be referred to as the "automatic composite revolution control" as one type of automatic control (machine control function).

In the present embodiment, by individually and automatically adjusting the pilot pressure acting on a control valve corresponding to each of the actuators, the automatic control part 54 can cause each of the actuators to operate automatically.

The automatic control part 54 may be configured to stop the automatic control in the case where a predetermined condition is satisfied. Here, "the case where a predetermined condition is satisfied" may include, for example, "a case where there is a tendency that information on the behavior of the excavator 100 is different from that in a normal operation". In the following, the function of stopping the automatic control in the case where a predetermined condition is satisfied, will be referred to as the "emergency stop function".

"information on the behavior of the excavator 100" is, for example, "information on operations performed on the operation device 26". The automatic control part 54 may be configured to determine that "there is a tendency that information on the behavior of the excavator 100 is different from that in a normal operation", for example, in the case where the operation device 26 is operated suddenly. Alternatively, "information on the behavior of the excavator 100" may be "information on operations performed on the revolution control lever installed in the revolving upper body 3". In this case, the automatic control part 54 may be configured to determine that "there is a tendency that information on the behavior of the excavator 100 is different from that in a normal operation", for example, in the case where an operation is executed to revolve the revolving upper body 3 in the opposite direction with respect to revolution executed by the automatic facing control or an automatic composite revolution control as the automatic control. In addition, the automatic control part 54 may be configured to stop the automatic control in the case where it is determined that "there is a tendency that information on the behavior of the excavator 100 is different from that in a normal operation".

Here, "the case where a predetermined condition is satisfied" may include, for example, "a case where the instability of the excavator 100 increases" such as "a case where the tilt of the revolving upper body 3 transitions to a predetermined state". Further, "the case where the tilt of the revolving upper body 3 transitions to a predetermined state" may include, for example, "a case where the pitch angle of the revolving upper body 3 becomes a predetermined angle"; "a case where the absolute value of the changing speed of the pitch angle (rate of change) becomes greater than or equal to a predetermined value"; "a case where the amount of change of the pitch angle becomes greater than or equal to a predetermined value"; and the like. The same applies to the roll angle. In this case, the automatic control part 54 may be configured to stop the automatic control, based on the output of the machine tilt sensor S4. Specifically, in the case of detecting that the pitch angle of the revolving upper body 3 becomes a predetermined angle based on the output of the machine tilt sensor S4, the automatic control part 54 may stop the automatic control, and switch the operation mode of the excavator 100 from the automatic control mode to the manual control mode.

Also, "the case where a predetermined condition is satisfied" may include, for example, "a case where the emergency stop switch 48 as a foot-pedal switch arranged at the operator's feet, is stepped on".

Figure 3:
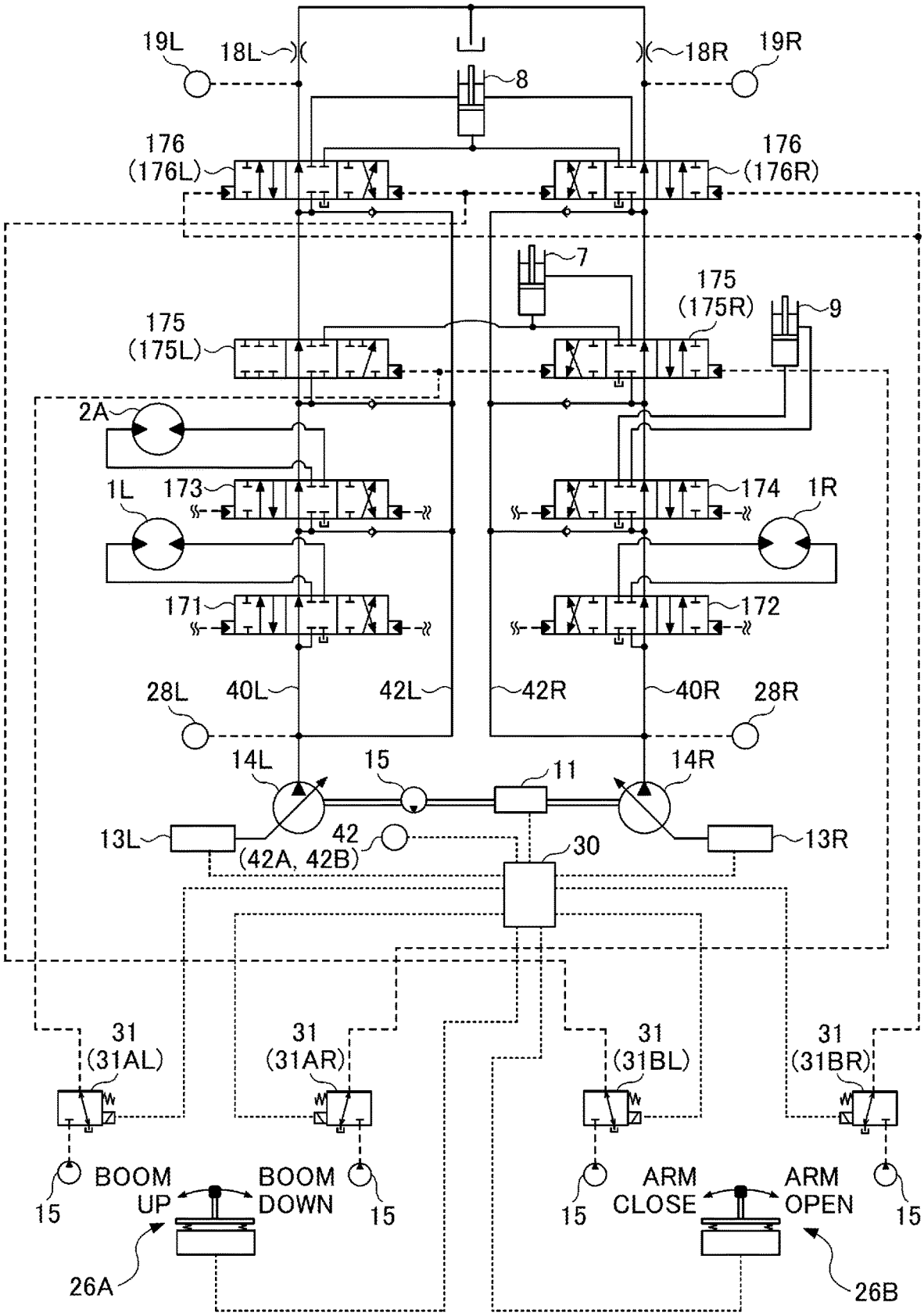
FIG. 3 is a diagram illustrating an example of a configuration of a hydraulic system installed in the excavator in FIG. 1.

Next, with reference to FIG. 3, an example of a configuration of a hydraulic system installed in the excavator 100 will be described. FIG. 3 illustrates an example of a configuration of a hydraulic system installed in the excavator 100 in FIG. 1. In FIG. 3, as in FIG. 2, mechanical power transmission lines, hydraulic oil lines, pilot lines, and electric control lines are designated with double lines, solid lines, dashed lines, and dotted lines, respectively.

The hydraulic system circulates hydraulic oil from the left main pump 14L driven by the engine 11 through a left center bypass pipeline 40L or a left parallel pipeline 42L to the hydraulic oil tank; and circulates hydraulic oil from the right main pump 14R driven by the engine 11 through a right center bypass pipeline 40R or a right parallel pipeline 42R to the hydraulic oil tank. The left main pump 14L and the right main pump 14R correspond to the main pump 14 in FIG. 2.

The left center bypass pipeline 40L is a hydraulic oil line passing through the control valves 171, 173, 175L, and 176L arranged in the control valves 17. The right center bypass pipeline 40R is a hydraulic oil line passing through the control valves 172, 174, 175R, and 176R arranged in the control valves 17. The control valves 175L and 175R correspond to the control valve 175 in FIG. 2. The control valves 176L and 176R correspond to the control valve 176 in FIG. 2.

The control valve 171 is a spool valve to supply hydraulic oil discharged by the left main pump 14L to the left hydraulic motor for traveling 1L, and to switch the flow of hydraulic oil discharged by the left hydraulic motor for traveling 1L so as to discharge the hydraulic oil into the hydraulic oil tank.

The control valve 172 is a spool valve to supply hydraulic oil discharged by the right main pump 14R to the right hydraulic motor for traveling 1R, and to switch the flow of hydraulic oil discharged by the right hydraulic motor for traveling 1R so as to discharge the hydraulic oil into the hydraulic oil tank.

The control valve 173 is a spool valve to supply hydraulic oil discharged by the left main pump 14L to the hydraulic motor for revolution 2A, and to switch the flow of hydraulic oil discharged by the hydraulic motor for revolution 2A so as to discharge the hydraulic oil into the hydraulic oil tank.

The control valve 174 is a spool valve to supply hydraulic oil discharged by the right main pump 14R to the bucket cylinder 9, and to switch the flow of hydraulic oil in the bucket cylinder 9 so as to discharge the hydraulic oil into the hydraulic oil tank.

The control valve 175L is a spool valve to switch the flow of hydraulic oil so as to supply hydraulic oil discharged by the left main pump 14L to the boom cylinder 7.

The control valve 175R is a spool valve to supply hydraulic oil discharged by the right main pump 14R to the boom cylinder 7, and to switch the flow of hydraulic oil in the boom cylinder 7 so as to discharge the hydraulic oil into the hydraulic oil tank.

The control valve 176L is a spool valve to supply hydraulic oil discharged by the left main pump 14L to the arm cylinder 8, and to switch the flow of hydraulic oil in the arm cylinder 8 so as to discharge the hydraulic oil into the hydraulic oil tank.

The control valve 176R is a spool valve to supply hydraulic oil discharged by the right main pump 14R to the arm cylinder 8, and to switch the flow of hydraulic oil in the arm cylinder 8 so as to discharge the hydraulic oil into the hydraulic oil tank.

The left parallel pipeline 42L is a hydraulic oil line parallel to the left center bypass pipeline 40L. The left parallel pipeline 42L can provide hydraulic oil to a downstream control valve in the case where the flow of hydraulic oil through the left center bypass pipeline 40L is restricted or cut off by one of the control valves 171, 173, and 175L. The right parallel pipeline 42R is a hydraulic oil line parallel to the right center bypass pipeline 40R. The right parallel pipeline 42R can provide hydraulic oil to a downstream control valve in the case where the flow of hydraulic oil through the right center bypass pipeline 40R is restricted or cut off by one of the control valves 172, 174, and 175R.

The left regulator 13L is configured to control the discharge amount of the left main pump 14L. In the present embodiment, for example, depending on the discharge pressure of the left main pump 14L, the left regulator 13L adjusts the tilt angle of the swashplate of the left main pump 14L, so as to control the discharge amount of the left main pump 14L. The right regulator 13R is configured to control the discharge amount of the right main pump 14R. In the present embodiment, for example, depending on the discharge pressure of the right main pump 14R, the right regulator 13R adjusts the tilt angle of the swashplate of the right main pump 14R, so as to control the discharge amount of the right main pump 14R. The left regulator 13L and the right regulator 13R correspond to the regulator 13 in FIG. 2. The left regulator 13L adjusts the tilt angle of the left main pump 14L, for example, in response to an increase in the discharge pressure of the left main pump 14L, so as to reduce the discharge amount. The same applies to the right regulator 13R. This is to control the absorbed horsepower of the main pump 14, which is expressed by a product of the discharge pressure and the discharge volume, so as not to exceed the output horsepower of the engine 11.

The left discharge pressure sensor 28L is an example of the discharge pressure sensor 28, that detects the discharge pressure of the left main pump 14L, and outputs the detected value to the controller 30. The same applies to the right discharge pressure sensor 28R.

Here, negative control adopted in the hydraulic system in FIG. 3 will be described.

Along the left center bypass pipeline 40L, a left throttle 18L is arranged between the control valve 176L located most downstream, and the hydraulic oil tank. The flow of hydraulic oil discharged by the left main pump 14L is restricted by the left throttle 18L. In addition, the left throttle 18L generates a control pressure for controlling the left regulator 13L. The left control pressure sensor 19L is a sensor for detecting the control pressure, and outputs a detected value to the controller 30. Along the right center bypass pipeline 40R, a right throttle 18R is arranged between the control valve 176R located most downstream, and the hydraulic oil tank. The flow of hydraulic oil discharged by the right main pump 14R is limited by the right throttle 18R. In addition, the right throttle 18R generates a control pressure for controlling the right regulator 13R. The right control pressure sensor 19R is a sensor for detecting the control pressure, and outputs a detected value to the controller 30.

In response to the control pressure, the controller 30 adjusts the tilt angle of the swashplate of the left main pump 14L, so as to control the discharge amount of the left main pump 14L. The controller 30 reduces the discharge amount of the left main pump 14L to be smaller while the control pressure becomes greater, and increases the discharge amount of the left main pump 14L to be greater while the control pressure becomes smaller. The controller 30 also controls the discharge amount of the right main pump 14R in substantially the same way.

Specifically, as illustrated in FIG. 3, in a stand-by state where none of the hydraulic actuators in the excavator 100 is operated, hydraulic oil discharged by the left main pump 14L reaches the left throttle 18L through the left center bypass pipeline 40L. Then, the flow of hydraulic oil discharged by the left main pump 14L increases the control pressure generated upstream of the left throttle 18L. As a result, the controller 30 reduces the discharge amount of the left main pump 14L down to the minimum allowable discharge amount, to control pressure loss (pumping loss) when the discharged hydraulic oil passes through the left center bypass pipeline 40L. On the other hand, in the case where one of the hydraulic actuators is operated, the hydraulic oil discharged by the left main pump 14L flows into the hydraulic actuator through a control valve corresponding to the hydraulic actuator to be operated. Then, the flow of hydraulic oil discharged by the left main pump 14L reduces or eliminates the amount to reach the left throttle 18L, which reduces the control pressure generated upstream of the left throttle 18L. As a result, the controller 30 increases the discharge amount of the left main pump 14L, to cause a sufficient amount of hydraulic oil to circulate in the hydraulic actuator to be operated, so as to securely drive the hydraulic actuator to be operated. The same applies to hydraulic oil discharged by the right main pump 14R.

With the configuration as described above, the hydraulic system in FIG. 3 can reduce wasteful energy consumption in each of the left main pump 14L and the right main pump 14R in a stand-by state. Wasteful energy consumption includes pumping loss generated in the left center bypass pipeline 40L by hydraulic oil discharged by the left main pump 14L, and pumping loss generated in the right center bypass pipeline 40R by hydraulic oil discharged by the right main pump 14R. Also, in the case of operating a hydraulic actuator, the hydraulic system in FIG. 3 can supply the necessary and sufficient hydraulic oil from each of the left main pump 14L and the right main pump 14R in a stand-by state, to the hydraulic actuator to be operated.

Next, a configuration that automatically operates the actuators will be described. The boom operation lever 26A is an example of the operation device 26, and is used for operating the boom 4. The boom operation lever 26A detects the operational direction and the operational amount of the lever, and outputs the detected operational direction and the operational amount to the controller 30 as operational data (an electric signal). While the manual control is performed, in the case where the boom operation lever 26A is operated in the boom-up direction, the controller 30 controls the opening of the proportional valve 31AL according to the operational amount of the boom operation lever 26A. In this way, by using hydraulic oil discharged by the pilot pump 15, the controller 30 causes the pilot pressure to act on the right pilot port of the control valve 175L and the left pilot port of the control valve 175R according to the operational amount of the boom operation lever 26A. Also, while the manual control is performed, in the case where the boom operation lever 26A is operated in the boom-down direction, the controller 30 controls the opening of the proportional valve 31AR according to the operational amount of the boom operation lever 26A. In this way, by using hydraulic oil discharged by the pilot pump 15, the controller 30 causes the pilot pressure to act on the right pilot port of the control valve 175R according to the operational amount of the boom operation lever 26A.

The proportional valves 31AL and 31AR constitute the boom proportional valve 31A as an example of the proportional valve 31. The proportional valve 31AL operates in response to a current command adjusted by the controller 30. The controller 30 adjusts the pilot pressure generated with hydraulic oil from the pilot pump 15, and introduced to the right pilot port of the control valve 175L and to the left pilot port of the control valve 175R, via the proportional valve 31AL. The proportional valve 31AR operates in response to a current command adjusted by the controller 30. The controller 30 adjusts the pilot pressure generated with hydraulic oil from the pilot pump 15, and introduced to the right pilot port of the control valve 175R, via the proportional valve 31AL. The proportional valves 31AL and 31AR can adjust the pilot pressure so as to stop the control valves 175L and 175R at any respective valve positions.

With this configuration, regardless of a boom-up operation performed by the operator, the controller 30 can supply hydraulic oil discharged by the pilot pump 15 to the right pilot port of the control valve 175L and the left pilot port of the control valve 175R, via the proportional valve 31AL. In other words, the boom 4 can be raised automatically. Also, regardless of a boom-down operation performed by the operator, the controller 30 can supply hydraulic oil discharged by the pilot pump 15 to the right pilot port of the control valve 175R, via the proportional valve 31AR. In other words, the controller 30 can automatically lower the boom 4.

The arm operation lever 26B is an example of the operation device 26, and is used for operating the arm 5. The arm operation lever 26B detects the operational direction and the operational amount of the lever, and outputs the detected operational direction and the operational amount to the controller 30 as operational data (an electric signal). While the manual control is performed, in the case where the arm operation lever 26B is operated in the arm opening direction, the controller 30 controls the opening of the proportional valve 31BR according to the operational amount of the arm operation lever 26B. In this way, by using hydraulic oil discharged by the pilot pump 15, the controller 30 causes the pilot pressure to act on the left pilot port of the control valve 176L and the right pilot port of the control valve 176R according to the operational amount of the arm operation lever 26B. Also, while the manual control is performed, in the case where the arm operation lever 26B is operated in the arm closing direction, the controller 30 controls the opening of the proportional valve 31BL according to the operational amount of the arm operation lever 26B. In this way, by using hydraulic oil discharged by the pilot pump 15, the controller 30 causes the pilot pressure to act on the right pilot port of the control valve 176L and the left pilot port of the control valve 176R according to the operational amount of the arm operation lever 26B.

The proportional valves 31BL and 31BR constitute the arm proportional valve 31B as an example of the proportional valve 31. The proportional valve 31BL operates in response to a current command adjusted by the controller 30. The controller 30 adjusts the pilot pressure generated with hydraulic oil from the pilot pump 15, and introduced to the right pilot port of the control valve 176L and to the left pilot port of the control valve 176R, via the proportional valve 31BL. The proportional valve 31BR operates in response to a current command adjusted by the controller 30. The controller 30 adjusts the pilot pressure generated with hydraulic oil from the pilot pump 15, and introduced to the left pilot port of the control valve 176L and to the right pilot port of the control valve 176R, via the proportional valve 31BR. The proportional valves 31BL and 31BR can adjust the pilot pressure so as to stop the control valves 176L and 176R at any respective valve positions.

With this configuration, regardless of an arm-closing operation performed by the operator, the controller 30 can supply hydraulic oil discharged by the pilot pump 15 to the right pilot port of the control valve 176L and the left pilot port of the control valve 176R, via the proportional valve 31BL. In other words, the controller 30 can close the arm 5 automatically. Also, regardless of an arm-opening operation performed by the operator, the controller 30 can supply hydraulic oil discharged by the pilot pump 15 to the left pilot port of the control valve 176L and the right pilot port of the control valve 176R, via the proportional valve 31BR. In other words, the controller 30 can open the arm 5 automatically.

In this way, in the automatic excavation control, according to the operational amount of the arm operation lever 26B, the speed control or the position control of a working member is executed by the arm cylinder 8 and the boom cylinder 7 that operate automatically.

The excavator 100 may be provided with an element to automatically cause the revolving upper body 3 to make a left revolution or a right revolution; an element to automatically cause the bucket 6 to open or close; and an element to automatically cause the traveling lower body 1 to travel forward or backward. In this case, part of the hydraulic system related to the operation of the hydraulic motor for revolution 2A; part of the hydraulic system related to the operation of the bucket cylinder 9; part of the hydraulic system related to the operation of the left hydraulic motor for traveling 1L; and part of the hydraulic system related to the operation of the right hydraulic motor for traveling 1R, may be configured in substantially the same way as part of the hydraulic system related to the operation of the boom cylinder 7 and the like.

Figure 4:
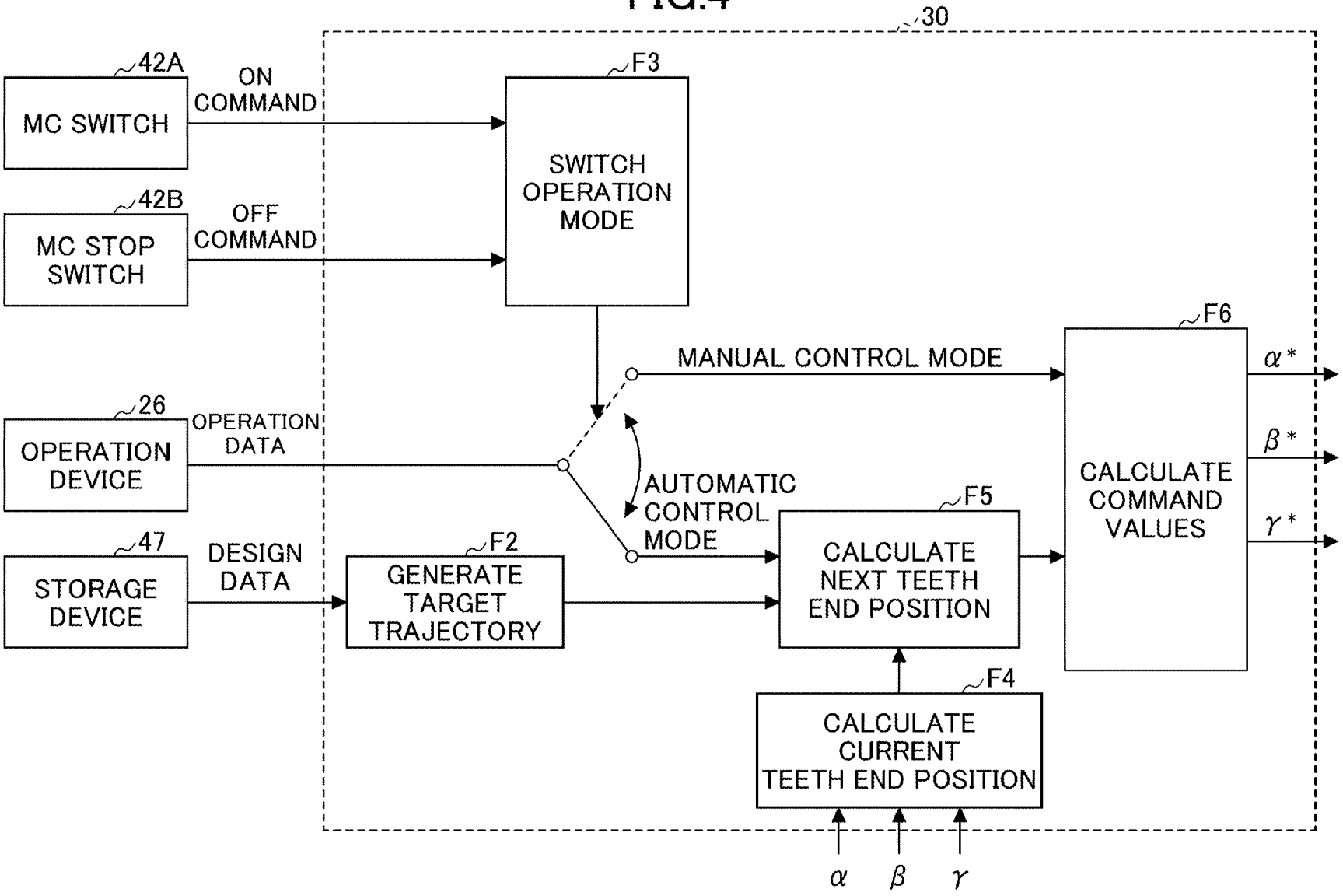
FIG. 4 is a block diagram illustrating an example of a relationship among functional elements related to execution of automatic control in a controller.

Next, the automatic control executed by the controller 30 will be described in detail with reference to FIG. 4. FIG. 4 is a block diagram illustrating an example of a relationship among functional elements F2 to F6 related to execution of automatic control in the controller 30.

As illustrated in FIG. 4, the controller 30 includes functional elements F2 to F6 related to execution of the automatic control. The functional elements may be implemented by software, may be implemented by hardware, or may be implemented by a combination of software and hardware.

The functional element F2 is configured to generate a target trajectory. In the present embodiment, the functional element F2 refers to design data stored in the storage device 47, to generate a trajectory to be traced by the teeth end of the bucket 6 during finishing work of a slope face.

The functional element F3 is configured to switch the operational mode of the excavator 100. In the present embodiment, in response to receiving an ON command from the MC switch 42A, the functional element F3 switches the operation mode of the excavator 100 from the manual control mode to the automatic control mode; and in response to receiving an OFF command from the MC switch 42B, the functional element F3 switches the operation mode of the excavator 100 from the automatic control mode to the manual control mode.

Once switched to the automatic control mode, the operational data as the output of the operation device 26, is supplied to the functional element F5. Once switched to the manual control mode, the operational data as the output of the operation device 26, is supplied to the functional element F6.

The functional element F4 is configured to calculate the current position of the teeth end. In the present embodiment, the functional element F4 calculates the coordinate point of the teeth end of the bucket 6 as the current position of the teeth end, based on a boom angle $\alpha$ detected by the boom angle sensor S1, an arm angle $\beta$ detected by the arm angle sensor S2, and a bucket angle $\gamma$ detected by the bucket angle sensor S3. The functional element F4 may use the output of the machine tilt sensor S4 when calculating the current position of the teeth end.

The functional element F5 is configured to calculate the next position of the teeth end when the automatic control mode is selected. In the present embodiment, when the automatic control mode is selected, the functional element F5 calculates the position of the teeth end after a predetermined period of time as the target position of the teeth end, based on the operation data output by the operation device 26, the target trajectory generated by the functional element F2, and the current position of the teeth end calculated by the functional element F4.

The functional element F6 is configured to calculate command values for operating the actuators. In the present embodiment, when the automatic control mode is selected, in order to move the current teeth end position to the target teeth end position, based on the target teeth end position calculated by the functional element F5, the functional element F6 calculates at least one of a boom command value $\alpha^*$, an arm command value $\beta^*$, and a bucket command value $\gamma^*$.

Also, when the manual control mode is selected, based on the operational data, in order to implement movement of the actuator in accordance with the operational data, the functional element F6 calculates at least one of a boom command value $\alpha^*$, an arm command value $\beta^*$, and a bucket command value $\gamma^*$.

In the case where the automatic control mode is selected, even when the boom operation lever 26A is not operated, the functional element F6 calculates the boom command value $\alpha^*$ as necessary. This is to operate the boom 4 automatically. The same applies to the arm 5 and the bucket 6.

On the other hand, in the case where the manual control mode is selected, when the boom operation lever 26A is not operated, the functional element F6 does not calculate the boom command value $\alpha^*$. This is because the boom 4 would not be operated unless the boom operation lever 26A is operated. The same applies to the arm 5 and the bucket 6.

Figure 5:
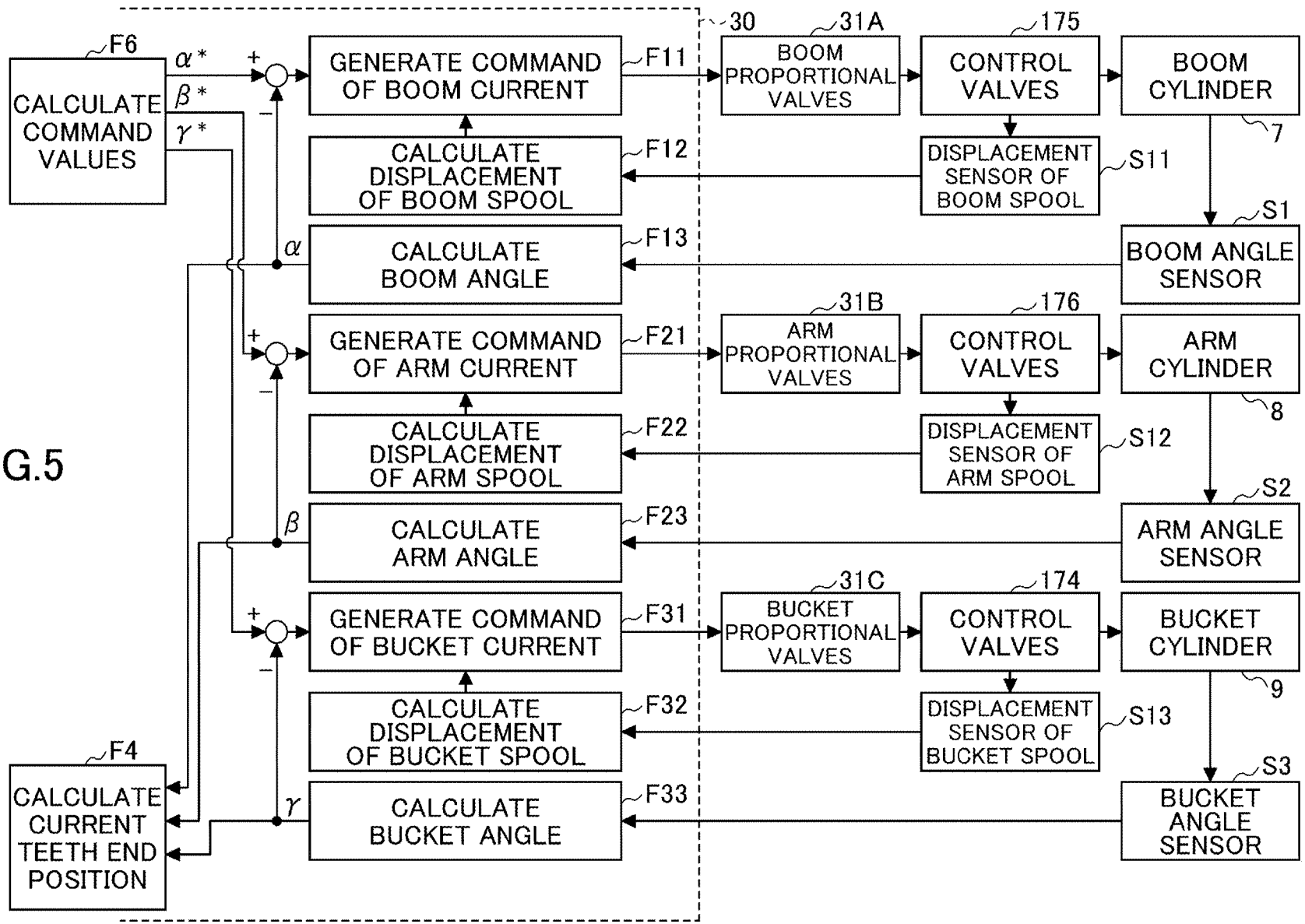
FIG. 5 is a block diagram illustrating an example of a configuration of functional elements that calculate various command values.

Next, with reference to FIG. 5, the functional element F6 will be described in detail. FIG. 5 is a block diagram illustrating an example of a configuration of the functional element F6 that calculates various command values.

The controller 30 further includes functional elements F11 to F13, F21 to F23, and F31 to F33 related to generation of the command values, as illustrated in FIG. 5. The functional elements may be implemented by software, may be implemented by hardware, or may be implemented by a combination of software and hardware.

The functional elements F11 to F13 are functional elements related to the boom command value $\alpha^*$; the functional elements F21 to F23 are functional elements related to the arm command value $\beta^*$; and the functional elements F31 to F33 are functional elements related to the bucket command value $\gamma^*$.

The functional elements F11, F21, and F31 are configured to generate electric current commands output to the proportional valves 31. In the present embodiment, the functional element F11 outputs a boom current command to the boom proportional valves 31A (see FIG. 3); the functional element F21 outputs an arm current command to the arm proportional valves 31B (see FIG. 3); and the functional element F31 outputs a bucket current command to the bucket proportional valve 31C.

Each of the functional elements F12, F22, and F32 is configured to calculate the displacement of a spool constituting a spool valve. In the present embodiment, the functional element F12 calculates the amount of displacement of a boom spool constituting the control valve 175 related to the boom cylinder 7, based on the output of a boom spool displacement sensor S11. The functional element F22 calculates the amount of displacement of an arm spool constituting the control valve 176 related to the arm cylinder 8, based on the output of an arm spool displacement sensor S12. The functional element F23 calculates the amount of displacement of a bucket spool constituting the control valve 174 related to the bucket cylinder 9, based on the output of a bucket spool displacement sensor S13.

Each of the functional elements F13, F23, and F33 is configured to calculate the angle of rotation of an operating member. In the present embodiment, the functional element F13 calculates the boom angle α based on the output of the boom angle sensor S1. The functional element F23 calculates the arm angle β based on the output of the arm angle sensor S2. The functional element F33 calculates the bucket angle γ based on the output of the bucket angle sensor S3.

Specifically, the functional element F11 basically generates a boom current command to the boom proportional valve 31A so as to make the difference become zero between the command value α* generated by the functional element F6, and the boom angle α calculated by the functional element F13. At this time, the functional element F11 adjusts the boom current command so as to make the difference become zero between the target boom spool displacement amount derived from the boom current command, and the boom spool displacement amount calculated by the functional element F12. Then, the functional element F11 outputs the adjusted boom current command to the boom proportional valve 31A.

The boom proportional valve 31A changes the opening area according to the boom current command, to cause a pilot pressure corresponding to the magnitude of the boom current command to act on the pilot port of the control valve 175. The control valve 175 moves the boom spool according to the pilot pressure to flow hydraulic oil into the boom cylinder 7. The boom spool displacement sensor S11 detects the displacement of the boom spool, and feeds the detection result back to the functional element F12 of the controller 30. The boom cylinder 7 extends or contracts in response to the inflow of the hydraulic oil to move the boom 4 up or down. The boom angle sensor S1 detects the angle of rotation of the boom 4 moving up or down, and feeds the detection result back to the functional element F13 of the controller 30. The functional element F13 feeds the calculated boom angle α back to the functional element F4.

The functional element F21 basically generates an arm current command to the arm proportional valve 31B so as to make the difference become zero between the command value β* generated by the functional element F6, and the arm angle β calculated by the functional element F23. At this time, the functional element F21 adjusts the arm current command so as to make the difference become zero between the target arm spool displacement amount derived from the arm current command, and the arm spool displacement amount calculated by the functional element F22. Then, the functional element F21 outputs the adjusted arm current command to the arm proportional valve 31B.

The arm proportional valve 31B changes the opening area according to the arm current command, to cause a pilot pressure corresponding to the magnitude of the arm current command to act on the pilot port of the control valve 176. The control valve 176 moves the arm spool according to the pilot pressure to flow hydraulic oil into the arm cylinder 8. The arm spool displacement sensor S12 detects the displacement of the arm spool, and feeds the detection result back to the functional element F22 of the controller 30. The arm cylinder 8 extends or contracts in response to the inflow of the hydraulic oil to open or close the arm 5. The arm angle sensor S2 detects the angle of rotation of the arm 5 that is opening or closing, and feeds the detection result back to the functional element F23 of the controller 30. The functional element F23 feeds the calculated arm angle β back to the functional element F4.

Similarly, the functional element F31 basically generates a bucket current command to the bucket proportional valve 31C so as to make the difference become zero between the command value γ* generated by the functional element F6, and the bucket angle γ calculated by the functional element F33. At this time, the functional element F31 adjusts the bucket current command so as to make the difference become zero between the target bucket spool displacement amount derived from the bucket current command, and the bucket spool displacement amount calculated by the functional element F32. Then, the functional element F31 outputs the adjusted bucket current command to the bucket proportional valve 31C.

The bucket proportional valve 31C changes the opening area according to the bucket current command, to cause a pilot pressure corresponding to the magnitude of the bucket current command to act on the pilot port of the control valve 174. The control valve 174 moves the bucket spool according to the pilot pressure to flow hydraulic oil into the bucket cylinder 9. The bucket spool displacement sensor S13 detects the displacement of the bucket spool, and feeds the detection result back to the functional element F32 of the controller 30. The bucket cylinder 9 extends or contracts in response to the inflow of the hydraulic oil to open or close the bucket 6. The bucket angle sensor S3 detects the angle of rotation of the bucket 6 that is opening or closing, and feeds the detection result back to the functional element F33 of the controller 30. The functional element F33 feeds the calculated bucket angle γ back to the functional element F4.

As described above, the controller 30 is configured to include a three-stage feedback loop for each operating member. In other words, the controller 30 is configured to include a feedback loop related to the spool displacement amount, a feedback loop related to the angle of rotation of the operating member, and a feedback loop related to the position of the teeth end. Therefore, the controller 30 can control the motion of the teeth end of the bucket 6 with high accuracy during automatic control.

[Electric Manual Control]

Figure 6:
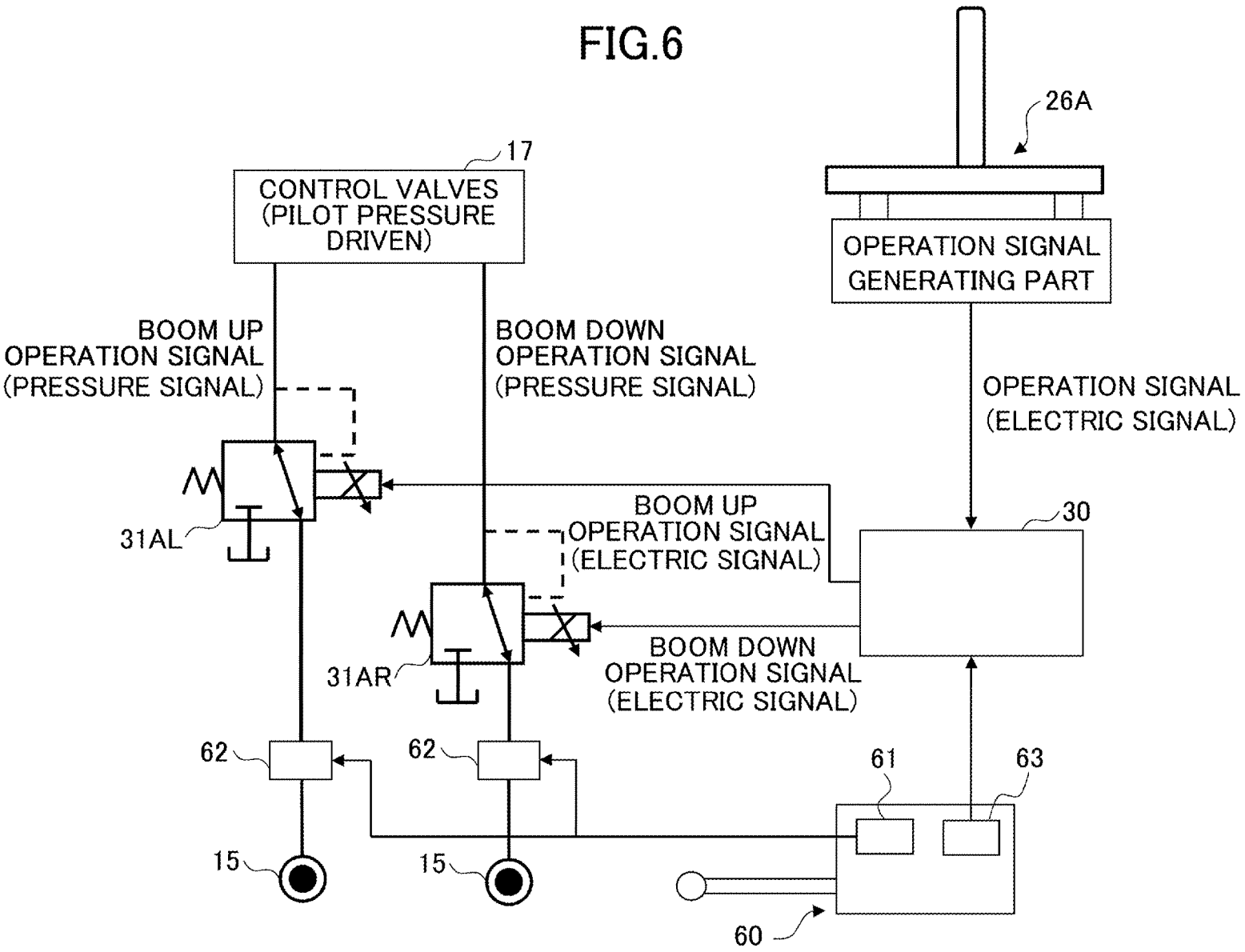
FIG. 6 is a schematic diagram illustrating an example of a configuration of an electric operation system of an excavator according to the present embodiment.

Next, with reference to FIG. 6, an electric operation system of the excavator 100 according to the present embodiment will be further described. FIG. 6 is a schematic diagram illustrating an example of a configuration of an electric operation system of the excavator 100 according to the present embodiment. Note that in FIG. 6, as an example of the electric operation system, a boom operation system that moves the boom 4 up and down will be exemplified. Note that the electric operation system may also be applied to a traveling operation system for causing the traveling lower body 1 to travel forward or backward; a revolution operation system for causing the revolving upper body 3 to make a revolution; an arm operation system for causing the arm 5 to open or close; a bucket operation system for causing the bucket 6 to open or close; and the like.

The electric operation system illustrated in FIG. 6 is provided with a boom operation lever 26A as an electric operation lever; a pilot pump 15; pilot pressure-driven control valves 17; a proportional valve 31AL for a boom-up operation; a proportional valve 31AR for a boom-up operation; a controller 30; a gate lock lever 60; and a gate lock valve 62.

The boom operation lever 26A (an operation signal generating part) as an example of an operation device, is provided with a sensor such as an encoder or a potentiometer that can detect the operational amount (amount of tilt) and the tilted direction. An operation signal (an electric signal) corresponding to an operation on the boom operation lever 26A detected by the sensor of the boom operation lever 26A is taken into the controller 30.

The proportional valve 31AL is provided on a pilot line that supplies hydraulic oil from the pilot pump 15 to the boom-up-side pilot port of the control valves 17 (see the control valves 175L and 175R illustrated in FIG. 3). The proportional valve 31AL is a solenoid valve whose opening can be adjusted, where the opening of the proportional valve 31AL is controlled in response to a boom-up operation signal (an electric signal) from the controller 30. By controlling the opening of the proportional valve 31AL, the pilot pressure as the boom-up operation signal (a pressure signal) acting on the boom-up-side pilot port is controlled. Similarly, the proportional valve 31AR is provided on a pilot line that supplies hydraulic oil from the pilot pump 15 to the boom-down-side pilot port of the control valves 17 (see the control valves 175L and 175R illustrated in FIG. 2). The proportional valve 31AR is a solenoid valve whose opening can be adjusted, where the opening of the proportional valve 31AR is controlled in response to a boom-down operation signal (an electric signal) from the controller 30. By controlling the opening of the proportional valve 31AR, the pilot pressure as the boom-down operation signal (a pressure signal) acting on the boom-down-side pilot port is controlled.

The controller 30 outputs a boom-up operation signal (an electric signal) or a boom-down operation signal (an electric signal) that controls the opening of the proportional valves 31AL and 31AR. In this way, the controller 30 can control the flow rate and the flowing direction of hydraulic oil supplied by the main pumps 14L and 14R to boom cylinder 7, through the proportional valves 31AL and 31AR, and the control valves 17 (the control valves 175L and 175R), to control the operation of the boom 4.

For example, in the case where a manual operation is performed, the controller 30 generates and outputs a boom-up operation signal (an electric signal) or a boom-down operation signal (an electric signal) in response to an operation signal (an electric signal) of the boom operation lever 26A. Also, for example, in the case where automatic control of the excavator 100 is performed, the controller 30 generates and outputs a boom-up operation signal (an electric signal) or a boom-down operation signal (an electric signal), based on a program or the like that has been set.

The gate lock lever 60 is arranged in the vicinity of the entrance door in the cabin 10. The gate lock lever 60 is provided to be swingable. The operator pulls up the gate lock valve 62 to make it almost level, so as to make the gate lock lever 60 transition to the released state, and pushes down the gate lock valve 62 so as to make the gate lock lever 60 transition to the locked state. In a state of the gate lock lever 60 being pulled up, the gate lock lever 60 closes the entrance door of the cabin 10 to restrict the operator to leave the cabin 10. On the other hand, in a state of the gate lock lever 60 being pushed down, the gate lock lever 60 opens the entrance door of the cabin 10 to allow the operator to leave the cabin 10.

The limit switch 61 is a switch that turns on (being conductive) in a state of the gate lock lever 60 being pulled up, and turns off (being cut off) in a state of the gate lock lever 60 being pushed down.

The gate lock valve 62 is an opening/closing valve that is arranged on a pilot line between the pilot pump 15 and the proportional valves 31 (31AL and 31AR). The gate lock valve 62 is, for example, a solenoid valve that opens when being conductive and closes when not being conductive. The limit switch 61 is arranged in the power supply circuit of the gate lock valve 62. In this way, when the limit switch 61 is turned off, the gate lock valve 62 closes. When the limit switch 61 is turned on, the gate lock valve 62 opens. In other words, when the gate lock valve 62 is in the released state, the gate lock valve 62 opens. On the other hand, when the gate lock valve 62 is in the locked state, the gate lock valve 62 closes.

The lock condition detection sensor 63 detects whether the gate lock valve 62 is in the released state or in the locked state. For example, the lock condition detection sensor 63 is a voltage sensor (or a current sensor) provided in an electric circuit that connects the gate lock valve 62 with the limit switch 61, and detects whether the gate lock valve 62 is in the released state or in the locked state, to detect whether the limit switch 61 is turned on or off. The detection result is output to the controller 30. Note that the lock condition detection sensor 63 may be configured to detect whether the gate lock valve 62 is in the released state or in the locked state by directly detecting the position of the lever.

Figure 7:
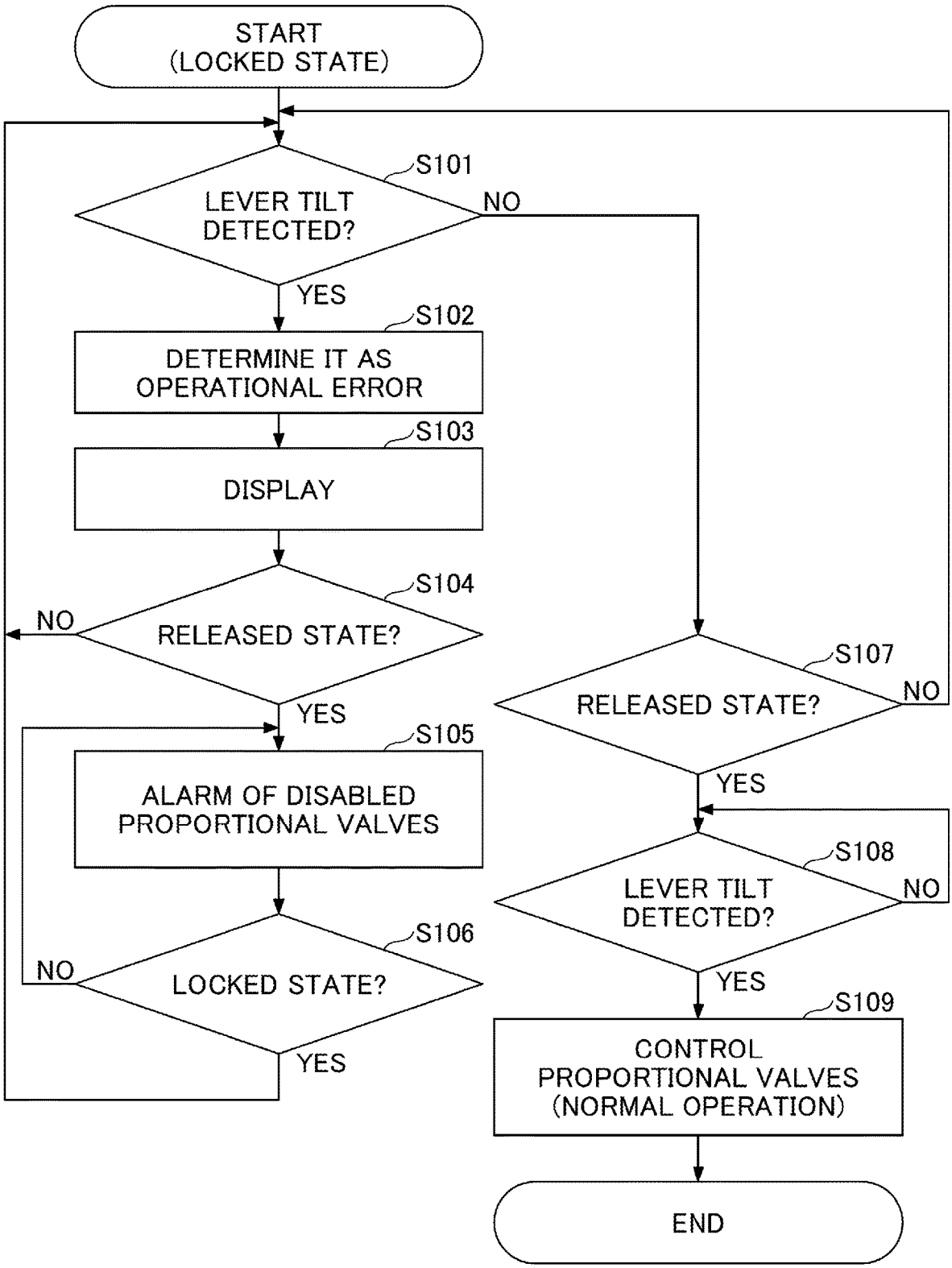
FIG. 7 is a flowchart illustrating an example of control executed by a controller.

FIG. 7 is a flowchart illustrating an example of control executed by the controller 30. Note that the following description assumes that at the start of a control flow, the gate lock valve 62 is in the locked state by the gate lock lever 60.

At Step S101, the controller 30 determines whether or not a tilt of the boom operation lever 26A is detected. Note that the controller 30 detects a tilt of the boom operation lever 26A, based on the operation signal (an electric signal) of the boom operation lever 26A. If a tilt of the boom operation lever 26A is detected (YES at S101), processing by the controller 30 proceeds to Step S102. If a tilt of the boom operation lever 26A is not detected (NO at S101), processing by the controller 30 proceeds to Step S107.

At Step S102, the controller 30 determines that the tilt is caused by an operational error on the boom operation lever 26A. Note that in the case where the operational error is determined, the controller 30 invalidates the operation signal (an electric signal) of the boom operation lever 26A, so as not to output the boom-up operation signal (an electric signal) and the boom-down operation signal (an electric signal) to the proportional valves 31AL and 31AR. Also, at Step S102, the gate lock valve 62 is closed, and hydraulic oil from the pilot pump 15 is not supplied to the proportional valves 31AL and 31AR. Therefore, the boom cylinder 7 is not driven. Also, in the above description, although the controller 30 has been described as not outputting an operation signal (an electric signal) to the proportional valves 31AL and 31AR, it is not limited as such. In the case where the operational error is determined, the controller 30 may disable the operation of the operation lever by outputting an electric signal to the limit switch, to close the gate lock valve 62. In this case, a limit switch other than the limit switch 61 may be provided separately.

At Step S103, the controller 30 causes the display device 40 to display an indication that the boom operation lever 26A is tilted. For example, the display 40 displays an icon indicating the tilt of the lever. In this way, the operator is informed that the boom operation lever 26A is being tilted.

At Step S104, the controller 30 determines whether or not the gate lock valve 62 is in the released state by the gate lock lever 60, based on the detection signal of the lock condition detection sensor 63. If it is in the released state (YES at S104), processing by the controller 30 proceeds to Step S105. If it is not in the released state (NO at S104), processing by the controller 30 returns to Step S101.

At Step S105, the controller 30 disables the control of the proportional valve 31. In other words, the controller 30 invalidates the operation signal (an electric signal) of the boom operation lever 26A, so as not to output the boom-up operation signal (an electric signal) and the boom-down operation signal (an electric signal) to the proportional valves 31AL and 31AR. Note that at Step S105, the gate lock valve 62 opens, and hydraulic oil from the pilot pump 15 is supplied to the proportional valves 31AL and 31AR. However, the hydraulic oil is not supplied to the control valve 17 to disable the control of the proportional valve 31. Therefore, the boom cylinder 7 is not driven.

Also, the controller 30 raises an alarm. For example, in addition to the display on the display 40, the controller 30 causes the sound output device 43 to output a sound indicating that the boom operation lever 26A is tilted. In this way, it is possible to securely inform the operator that the boom operation lever 26A is being tilted.

At Step S106, the controller 30 determines whether or not the gate lock valve 62 is in the locked state by the gate lock lever 60, based on the detection signal of the lock condition detection sensor 63. If it is in the locked state (YES at S106), processing by the controller 30 returns to Step S101. If it is not in the locked state (NO at S106), the processing from Step S105 to Step S106 is repeated by the controller 30.

At Step S107, the controller 30 determines whether or not the gate lock valve 62 is in the released state by the gate lock lever 60, based on the detection signal of the lock condition detection sensor 63. If it is in the released state (YES at S107), processing by the controller 30 proceeds to Step S108. If it is not in the released state (NO at S107), processing by the controller 30 returns to Step S101.

At Step S108, the controller 30 determines whether or not a tilt of the boom operation lever 26A is detected. Note that the controller 30 detects a tilt of the boom operation lever 26A, based on the operation signal (an electric signal) of the boom operation lever 26A. If a tilt of the boom operation lever 26A is detected (YES at S108), processing by the controller 30 proceeds to Step S109. If a tilt of the boom operation lever 26A is not detected (NO at S108), the processing at Step S108 is repeated by the controller 30.

At Step S109, based on the operational amount of the pitch angle and the operational direction, the controller 30 controls the proportional valves 31AL and 31AR. In other words, at Step S109, the gate lock valve 62 opens, and hydraulic oil from the pilot pump 15 is supplied to the proportional valves 31AL and 31AR. Also, the controller 30 validates the operation signal of the boom operation lever 26A, and based on the operation signal (an electric signal) of the boom operation lever 26A, outputs the boom-up operation signal (an electric signal) and the boom-down operation signal (an electric signal) to the proportional valves 31AL and 31AR. In this way, the pilot pressure is supplied to the pilot port of the control valves 17, and the hydraulic oil is supplied to the boom cylinder 7. Therefore, the boom 4 moves up or down according to the operation of the boom operation lever 26A.

Here, in the excavator, a tilt of the lever unintended by the operator may occur in the excavator, when the gate lock valve 62 transitions from the locked state to the released state by the gate lock lever 60, due to the clothing or the like of the operator being caught in the lever of the operation device 26. In this case, in an excavator, an erroneous operation unintended by the operator would occur.

In contrast, according to the excavator 100 according to the present embodiment, in the case where the operation device 26 is operated with the gate lock lever 60 in the locked state of the gate lock valve 62 (YES at S101), it can be detected as an operational error (S102). Also, by using the electric operation device as the operation device 26, even if the gate lock valve 62 is in the locked state by the gate lock lever 60, the operational error (the tilt of the lever) can be detected. Also, by informing the operator about the tilt of the lever of the operation device 26, before causing the gate lock valve 62 to transition to the released state by the gate lock lever 60, it is possible to encourage the operator to have the lever of the operation device 26 return to the neutral state (S103).

Also, if the lever of the operation device 26 is in the neutral state, by having the gate lock valve 62 transition to the released state by the gate lock lever 60 (NO at S101, YES at S107), the operation signal (an electric signal) of the operation device 26 becomes effective (Steps S108 and S109). As the lever of the operation device 26 is in the neutral state, immediately after having the gate lock valve 62 transition to the released state by the gate lock lever 60, occurrence of an erroneous operation of the actuator that is not intended by the operator can be prevented.

On the other hand, while the lever of the operation device 26 is being tilted, even if having the gate lock valve 62 transition to the released state by the gate lock lever 60 to open the gate lock valve 62 (YES at S101, YES at S104), by invalidating the operation signal (an electric signal) of the operation device 26, an erroneous operation of the actuator that is not intended by the operator can be prevented (S105). Also, by raising the alarm, it is possible to securely inform the operator of the invalidated actuator operation (S105).

Also, in the case of invalidating the control of the proportional valve 31, if having the gate lock valve 62 transition to the locked state by the gate lock lever 60 (YES at S106), and then, having the lever of the operation device 26 return to the neutral state (NO at S101), by having the gate lock valve 62 transition to the released state again by the gate lock lever 60 (YES at S107), the control of the proportional valve 31 becomes enabled (S108 and S109). In this way, it is possible to securely prevent unintended occurrence of electric operation lever of operator.

As above, favorable embodiments according to the present inventive concept have been described in detail. However, the present inventive concept is not restricted to the embodiments described above. Various modifications, substitutions, and the like may be applied to the embodiments described above without deviating from the scope of the present inventive concept. Also, the separately described features can be combined unless a technical inconsistency is introduced.

In the case where the space recognition device S7 detects that an object has intruded within a predetermined range around the excavator 100, the controller 30 may determine the type of object and the distance to the object. Also, in the case where the intruding object is a person, even if it is determined at Step S107 as in the released state, the controller 30 invalidates the operation signal (an electric signal)

to the proportional valve of the operation device 26. In this way, the safety of the work site can be improved.

Also, in the case where a person intrudes within the predetermined range of the excavator 100, the controller 30 may output an electric signal to the limit switch to close the gate lock valve 62, so as to disable the operation of the operation device 26. In this way, the safety of the work site can be improved.

Also, the controller 30 may also transmit a record of determination of an operational error to a management device (not illustrated) through the communication device T1. Note that information to be transmitted to the management device includes the record of determination of the operational error, the model number of the excavator 100, information of the operator, the date and time, and the like.

Also, in the embodiment described above, the controller 30 causes the hydraulic motor for revolution 2A to operate automatically, so as to cause the revolving upper body 3 to face the target formation level. However, the controller 30 may cause an electric motor generator for revolution to operate automatically, so as to cause the revolving upper body 3 to face the target formation level.

Also, in the embodiment described above, although the operational data is generated in accordance with the operation device or a remote-controlled operation device, the data may be automatically generated by a predetermined operating program.

Also, the controller 30 may cause the other actuators to operate, so as to cause the revolving upper body 3 to face the target formation level. For example, the controller 30 may cause the left hydraulic motor for traveling 1L and the right hydraulic motor for traveling 1R to operate automatically, so as to cause the revolving upper body 3 to face the target formation level.

The invention claimed is:

1. An excavator comprising:

a control valve configured to control hydraulic oil to be supplied to an actuator, based on pilot pressure;

an electric operation device configured to be operated by an operator to output an electric operation signal;

a gate lock lever:

a gate lock valve provided on a pilot line supplying the pilot pressure to the control valve, and configured to open or close according to a state of the gate lock lever, so as to switch between a locked state and a released state;

a proportional valve provided on the pilot line; and a controller including a memory and a processor configured to receive as input the operation signal, to control the proportional valve, wherein the processor is configured to determine, in a case where the gate lock valve is in the locked state by the gate lock lever and an operation is performed on the electric operation device by the operator, the operation as an operational error.

2. The excavator as claimed in claim 1, wherein the processor is further configured to inform that the operational error is determined in a case where the operation is determined as the operational error.

3. The excavator as claimed in claim 1, wherein the processor is further configured to invalidate the operation signal, in a case where the operation is determined as the operational error.

4. The excavator as claimed in claim 1, wherein the processor is further configured to validate the operation signal in response to the gate lock valve being switched from the locked state to the released state by the gate lock lever with the electric operation device being in a neutral state, and control the proportional valve based on the operation signal.

5. The excavator as claimed in claim 1, Wherein the processor is configured to determine that the operation performed on the electric operation device by the operator is an erroneous operation unintended by the operator, in response to the operation being performed on the electric operation device by the operator with the gate lock lever being in the locked state.

* * * * *